US011061358B2

(12) United States Patent
Yoshikawa

(10) Patent No.: US 11,061,358 B2
(45) Date of Patent: Jul. 13, 2021

(54) TRANSFER DEVICE AND IMAGE FORMING APPARATUS

(71) Applicant: SHARP KABUSHIKI KAISHA, Sakai (JP)

(72) Inventor: Yoshihiro Yoshikawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/840,219

(22) Filed: Apr. 3, 2020

(65) Prior Publication Data

US 2020/0333743 A1 Oct. 22, 2020

(30) Foreign Application Priority Data

Apr. 17, 2019 (JP) ..... JP2019-078378

(51) Int. Cl.
*G03G 21/16* (2006.01)
*G03G 15/00* (2006.01)

(52) U.S. Cl.
CPC ..... *G03G 21/1652* (2013.01); *G03G 15/80* (2013.01); *G03G 21/168* (2013.01)

(58) Field of Classification Search
CPC ... G03G 21/1652; G03G 21/168; G03G 15/80
See application file for complete search history.

(56) References Cited

U.S. PATENT DOCUMENTS 6,421,521 B2 * 7/2002 Tanaka ..... G03G 15/0131 399/299
9,785,109 B2 * 10/2017 Ohata ..... G03G 21/1652
9,977,395 B2 * 5/2018 Shibuya ..... G03G 15/751
2013/0188982 A1 * 7/2013 Souda ..... G03G 21/1652 399/90

FOREIGN PATENT DOCUMENTS

JP 2005-114793 A 4/2005

* cited by examiner

*Primary Examiner* — Walter L Lindsay, Jr.
*Assistant Examiner* — Geoffrey T Evans
(74) *Attorney, Agent, or Firm* — ScienBiziP, P.C.

(57) ABSTRACT

To provide a transfer device including a plurality of transfer rollers, a transfer frame that supports one end of the transfer rollers, and a plurality of wiring members. The plurality of wiring members are wired on the transfer frame, and transfer device-side contact terminals formed at one ends of the wiring members are collectively arranged at one end of the transfer frame. A black wiring member is arranged on a first surface of the transfer frame, and a plurality of color wiring members are arranged on a second surface of the transfer frame.

7 Claims, 8 Drawing Sheets

TRANSFER DEVICE AND IMAGE FORMING APPARATUS

BACKGROUND OF THE INVENTION

Field of the Invention

The present invention relates to a transfer device and an image forming apparatus, and more particularly relates, for example, to a transfer device that is mounted to be attachable to and detachable from an apparatus main body and receives power supply from a high-voltage substrate provided in the apparatus main body, and relates also to an image forming apparatus including the transfer device.

Description of the Background Art

An example of such type of conventional image forming apparatus is disclosed in Japanese Unexamined Patent Application Publication No. 2005-114793 (hereinafter referred to as, "Patent Document 1"). In the technique of Patent Document 1, a power supply member (wiring member) that supplies power from a connection terminal of a high-voltage power source provided in an apparatus main body to a conductive bearing attached to an end of a power-supplied roller (such as a developing roller, a charging roller, a primary transfer roller, and the like) of a transfer device is accommodated in a face plate main body of a power supply face plate capable of opening and closing an opening of the apparatus main body.

The transfer device generally includes four transfer rollers corresponding to the four colors of YMCK, and the four transfer rollers receive power supply from a high-voltage substrate provided in the apparatus main body via a wiring member. Here, during monochrome printing in which voltage is applied only to the black transfer roller, a potential difference occurs between the color wiring members and the black wiring member. Further, a plurality of color transfer rollers are controlled at a constant voltage and only the black transfer roller is controlled at a constant current, and consequently, the voltage of the black wiring member increases depending on the resistance value of the applicator. Therefore, it is necessary to appropriately secure a creepage distance (and a space distance) between the color wiring members and the black wiring member.

However, according to the technique of Patent Document 1, the wiring members are accommodated in the face plate main body of the power supply face plate, which makes it difficult to secure the creepage distance between the wiring members. In Patent Document 1, it is not known how the wiring members that couple the high-voltage substrate and each of the four transfer rollers are arranged; however, it appears that by arranging three insulating plates in the face plate main body, or by using an insulated wire as the wiring member, a short circuit between the wiring members is prevented. However, this increases the number of components and also cost of the components.

Therefore, a main object of the present invention is to provide a novel transfer device and image forming apparatus.

Another object of the present invention is to provide a transfer device and an image forming apparatus by which it is possible to appropriately prevent a short circuit between wiring members with a simple configuration.

SUMMARY OF THE INVENTION

A first aspect of the present invention is a transfer device that is mounted to be attachable to and detachable from an apparatus main body and receives power supply from a high-voltage substrate provided on the apparatus main body. The transfer device includes a transfer belt, a plurality of transfer rollers that include a black transfer roller and a plurality of color transfer rollers, and are arranged side by side in a traveling direction of the transfer belt, a transfer frame that supports one end of the plurality of transfer rollers, and a plurality of wiring members that include a black wiring member and a plurality of color wiring members, and electrically connect a plurality of main body-side contact terminals provided on the apparatus main body and the plurality of transfer rollers when the transfer device is mounted on the apparatus main body. Each of the plurality of wiring members includes, at one end, a transfer device-side contact terminal that abuts against a corresponding main body-side contact terminal of the plurality of main body-side contact terminals when the transfer device is mounted on the apparatus main body. The plurality of wiring members are wired on the transfer frame, and the transfer device-side contact terminal includes a plurality of transfer device-side contact terminals collectively arranged at one end of the transfer frame. The black wiring member is wired on a surface of the transfer frame different from a surface on which the plurality of color wiring members are wired. According to the first invention, it is possible to secure a creepage distance and a space distance between the color wiring members and the black wiring member with a simple configuration in which the color wiring members are arranged on a first surface of the transfer frame, and the black wiring member is arranged on a second surface of the transfer frame. Thus, it is possible to appropriately prevent a short circuit between the wiring members.

The plurality of wiring members are wired on the transfer frame, and each of the transfer device-side contact terminals is collectively arranged at one end of the transfer frame, which makes it possible to shorten a wiring path in the transfer device, and easily secure the creepage distance and the space distance between the wiring members. It is also possible to shorten and simplify a wiring path in the apparatus main body, and thus, it is possible to realize space-saving and cost reduction for the wiring at the apparatus main body side. In addition, it is possible to set the positional relationship between the other end of the wiring member and the transfer roller to the same phase in each color, and have a common relay member in each color, by which the member cost can be reduced. A second aspect of the present invention depends upon the first invention, in which the plurality of color wiring members are wired on a same surface of the transfer frame.

A third aspect of the present invention depends upon the first or second invention, in which the transfer device is attached to and detached from an opening formed on a front surface of the apparatus main body, the plurality of transfer rollers are arranged to extend in a front-rear direction of the apparatus main body, and the transfer frame is a front frame that holds front ends of the plurality of transfer rollers.

A fourth aspect of the present invention depends upon the third invention, in which each of the plurality of color wiring members is wired on a bottom surface of the front frame, and the black wiring member is wired on a front surface of the front frame.

A fifth aspect of the present invention depends upon any one of the first to fourth inventions, in which a protrusion formed on the one end of the transfer frame to cover a peripheral edge of the transfer device-side contact terminal, is further included.

A sixth aspect of the present invention depends upon any one of the first to fifth inventions, in which a positioner that is provided at the one end of the transfer frame and positions the transfer device with respect to the apparatus main body, is further included.

A seventh aspect of the present invention is an image forming apparatus that includes an apparatus main body provided with a high-voltage substrate, and the transfer device according to any one of the first to sixth inventions that is mounted to be attachable to and detachable from the apparatus main body and receives power supply from the high-voltage substrate.

According to the present invention, it is possible to secure the creepage distance and the space distance between the color wiring members and the black wiring member with a simple configuration in which the color wiring members are arranged on a first surface of the transfer frame, and the black wiring member is arranged on a second surface of the transfer frame, and thus, appropriately prevent a short circuit between the wiring members.

The above object, other objects, features, and advantages of the present invention will become more apparent from the detailed description of embodiments given later with reference to the drawings.

DESCRIPTION OF THE PREFERRED EMBODIMENTS

First Embodiment

Figure 1:
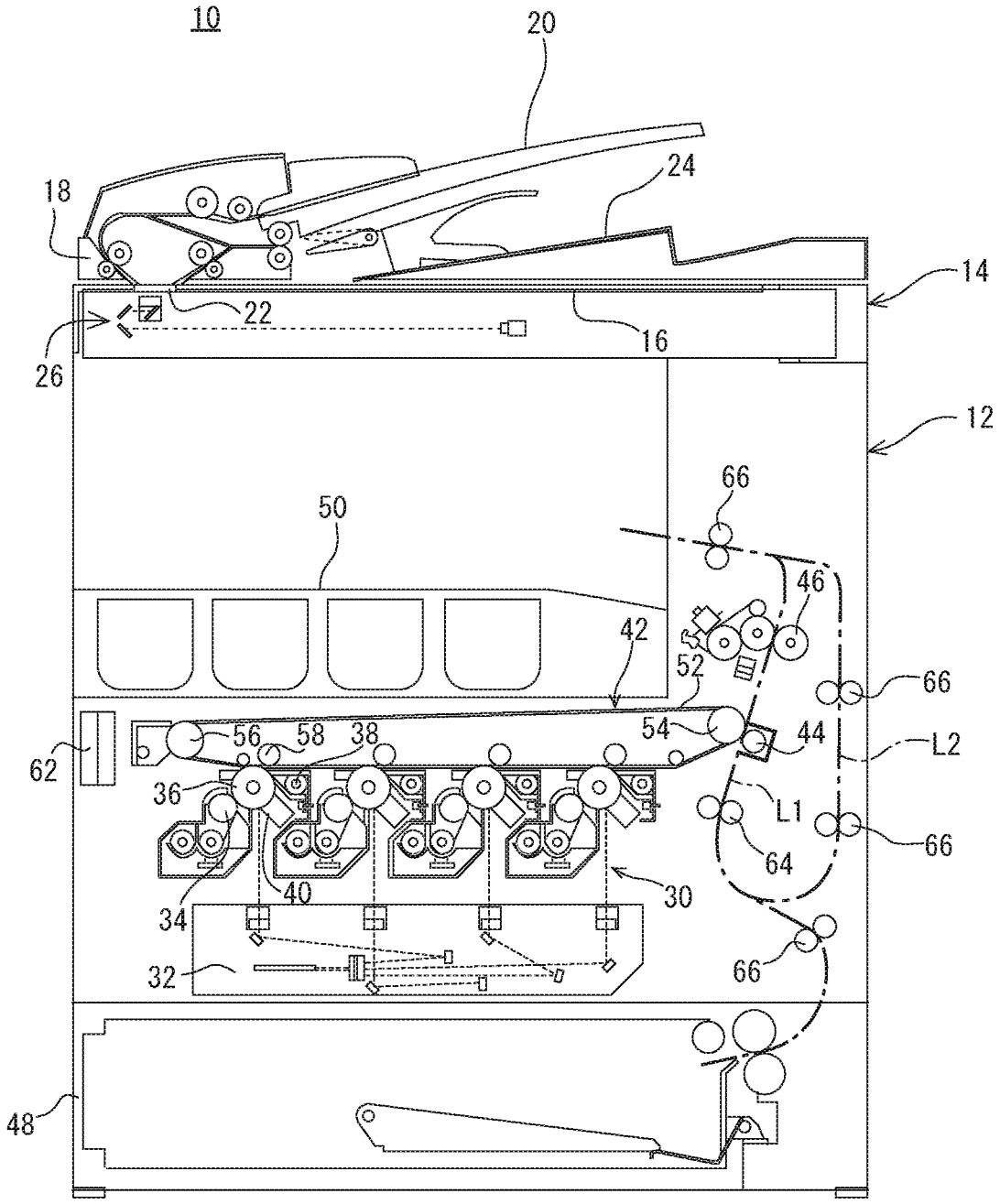
FIG. 1 is an illustrative view schematically illustrating an internal structure of an image forming apparatus including a transfer device according to a first embodiment of the present invention when viewed from a front side.

With reference to FIG. 1, an image forming apparatus 10 according to an embodiment of the present invention includes an apparatus main body 12 and a transfer device 42 mounted to be attachable to and detachable from the apparatus main body 12, and forms a color image or a monochrome image on a sheet (recording medium) by electrophotography. As will be described later in detail, the transfer device 42 includes four transfer rollers 58 corresponding to the four colors of YMCK, and the four transfer rollers 58 receive power supply from a high-voltage substrate provided in the apparatus main body 12 via a wiring member 74.

First, a configuration of the image forming apparatus 10 will be generally described. In the first embodiment, the front-rear direction (depth direction) of the image forming apparatus 10 and the components thereof is defined by assuming a surface facing a standing position of a user who operates the image forming apparatus 10, that is, a surface at a side on which an operation panel is provided as a front surface (front). Further, the left-right direction (lateral direction) of the image forming apparatus 10 and the components thereof is defined based on a state in which the image forming apparatus 10 is viewed from the user.

As illustrated in FIG. 1, the image forming apparatus 10 is a color multifunctional apparatus having a copying function, a printer function, a scanner function, a facsimile function, and the like, and includes the apparatus main body 12 including an image former 30, and an image reading device 14 arranged above the apparatus main body 12. It is noted that the image forming apparatus 10 may be any one of a copying machine, a facsimile, a printer, and the like, or a multifunctional apparatus in which at least two of the copying machine, the facsimile, the printer, and the like are combined.

The image reading device 14 includes a document platen 16 formed of a transparent material. A document pressing cover 18 is attached above the document platen 16 through a hinge or the like to be freely opened and closed. A document feed tray 20 is provided on an upper surface of the document pressing cover 18, and an automatic document feeder (ADF) is provided inside the document feed tray 20. The ADF automatically feeds documents placed on the document feed tray 20 one by one to an image reading position 22 and discharges the documents to a document discharge tray 24.

Further, an image reader 26 built in the image reading device 14 includes a light source, a plurality of mirrors, imaging lens, a line sensor, and the like. The image reader 26 exposes a document surface with light from the light source, and guides reflected light reflected from the document surface to the imaging lens by the plurality of mirrors. The reflected light is imaged on a light receiving element of the line sensor by the imaging lens. The line sensor detects the luminance and chromaticity of the reflected light imaged on the light receiving element, and image data is generated based on an image on the document surface. As the line sensor, a charge coupled device (CCD), a contact image sensor (CIS), or the like is used.

An operation panel (not illustrated) that receives an input operation such as a print instruction from a user is provided on a front surface side of the image reading device 14. The operation panel includes a display with a touch panel, a plurality of operation buttons, and the like.

Further, the apparatus main body 12 is provided with a controller (not illustrated) including a central processing unit (CPU), a memory, and the like, and the image former 30. The controller transmits a control signal to each component of the image forming apparatus 10, based on an input operation to the operation panel, or the like, and causes the image forming apparatus 10 to execute various operations.

The image former 30 includes an exposer 32, a developing device 34, a photosensitive drum 36, a cleaner 38, a charger 40, the transfer device (intermediate transfer device) 42, a secondary transfer roller 44, a fixer 46, and the like, and forms an image on a sheet conveyed from a sheet feed cassette 48 or the like, and discharges the imaged sheet to a sheet discharge tray 50. Image data read by the image reader 26 or image data transmitted from an external computer is used as image data to form the image on the sheet.

Image data processed in the image forming apparatus 10 corresponds to a color image of four colors of black (K), cyan (C), magenta (M), and yellow (Y). Thus, the developing device 34 includes four developing devices 34, the photosensitive drum 36 includes four photosensitive drums 36, the cleaner 38 includes four cleaners 38, and the charger 40 includes four chargers 40, to form four types of latent images corresponding to each of the colors, and the four developing device 34, photosensitive drums 36, cleaners 38, and chargers 40 constitute four image stations. The four image stations are arranged side by side in a line along a traveling direction (circular movement direction) of a surface of a transfer belt 52, and are arranged from the downstream side in the traveling direction of the transfer belt 52, that is, the side closer to the secondary transfer roller 44, in an order starting from an image station for black, an image station for cyan, an image station for magenta, and an image station for yellow. However, the order in which each color is arranged can be changed as appropriate.

The suffixes K, C, M, and Y added to the reference numerals indicate for what color the element is provided, and each of the suffixes K, C, M, and Y indicates black, cyan, magenta and yellow, respectively. However, in the description of each component, suffixes K, C, M, and Y will be omitted as appropriate and described in general, unless it is particularly necessary to distinguish for what component each color is used.

The photosensitive drum 36 is an image carrier in which a photosensitive layer is formed on a surface of a cylindrical base having conductivity, and is arranged such that a rotational axis thereof extends in the front-rear direction of the apparatus main body 12. The charger 40 is a member that charges the surface of the photosensitive drum 36 to a predetermined potential. The exposer 32 is configured as a laser scanning unit (LSU) including a laser emitter, a reflection mirror, and the like, and exposes the charged surface of the photosensitive drum 36 with light to form an electrostatic latent image corresponding to image data on the surface of the photosensitive drum 36. The developing device 34 visualizes the electrostatic latent image formed on the surface of the photosensitive drum 36 with four color (YMCK) toners. Further, the cleaner 38 removes the toner remaining on the surface of the photosensitive drum 36 after the image is developed and transferred.

The transfer device 42 includes the transfer belt (intermediate transfer belt) 52, a driving roller 54, a driven roller 56, the four transfer rollers (intermediate transfer rollers) 58 corresponding to the four colors, and the like, and is arranged above the photosensitive drum 36.

The transfer belt 52 is an endless belt having flexibility stretched by a plurality of rollers such as the driving roller 54 and the driven roller 56, and the transfer belt 52 is arranged such that the surface (outer peripheral surface) thereof abuts against the surface of the photosensitive drum 36. Thus, the transfer belt 52 moves around in a predetermined direction along with a rotary drive of the driving roller 54.

The transfer rollers 58 are arranged at a position facing each of the photosensitive drum 36 with the transfer belt 52 interposed therebetween. That is, the four transfer rollers 58 are arranged side by side in the traveling direction of the transfer belt 52, and a rotational axis of each of the transfer rollers 58 extends in the front-rear direction of the apparatus main body 12. During the image formation, predetermined voltage is applied to the transfer roller 58 to form a transfer electric field between the photosensitive drum 36 and the transfer belt 52. A toner image formed on the outer peripheral surface of each of the photosensitive drums 36 is sequentially transferred to the outer peripheral surface of the transfer belt 52 that moves around by an action of the transfer electric field.

Such the transfer device 42 is mounted to be attachable to and detachable from an accommodator of the transfer device 42 through an opening 60 (see FIG. 2) formed on the front surface of the apparatus main body 12. As will be described in detail later, when the transfer device 42 is mounted on the apparatus main body 12, each of four transfer device-side contact terminals (input terminals) 78 corresponding to the four colors provided on the transfer device 42 is electrically connected to each of four main body-side contact terminals (output terminals) 70 provided in the apparatus main body 12.

The secondary transfer roller 44 is provided to press the transfer belt 52 in the vicinity of the driving roller 54. During the image formation, predetermined voltage is applied to the secondary transfer roller 44 to form a transfer electric field between the transfer belt 52 and the secondary transfer roller 44. While a sheet passes through a transfer nip between the transfer belt 52 and the secondary transfer roller 44, a toner image formed on the outer peripheral surface of the transfer belt 52 is transferred onto the sheet by the action of the transfer electric field.

The fixer 46 includes a heat roller and a pressure roller, and is arranged above the secondary transfer roller 44. The heat roller is set to have a predetermined fixing temperature, and the toner image transferred onto the sheet is melted, mixed, and pressed when the sheet passes through a nip area between the heat roller and the pressure roller, so that the toner image is thermally fixed to the sheet.

Further, in the apparatus main body 12, a first sheet conveyance path L1 is formed that feeds the sheets conveyed from the sheet feed cassette 48 or the like to the sheet discharge tray 50 via a registration roller 64, the secondary transfer roller 44, and the fixer 46. Further, a second sheet conveyance path L2 is formed to, when duplex printing is performed on a sheet, return the sheet that has been subjected to single-sided printing and then passed through the fixer 46 to the first sheet conveyance path L1 on the upstream side of the secondary transfer roller 44 in a sheet conveyance direction. In the first sheet conveyance path L1 and the second sheet conveyance path L2, a plurality of conveyance rollers 66 are provided, as appropriate, that applies a propelling force to the sheet in an auxiliary manner.

Further, a substrate unit 62 is detachably provided on the left side of the apparatus main body 12. The substrate unit 62 includes a high-voltage substrate (not illustrated) and a housing that accommodates the board. The high-voltage substrate receives power supply from a commercial power source and outputs predetermined voltage required for charging, development, and transfer to each component. In the first embodiment, the high-voltage substrate includes four output terminals (not illustrated) that applies predetermined voltage to each of the four transfer rollers 58, and the four output terminals are electrically connected to each of the four main body-side contact terminals 70 via wiring members.

Three output terminals of the high-voltage substrate that apply voltage to color transfer rollers 58Y, M, and C are branched in parallel from the same transformer, and the high-voltage substrate applies voltage controlled at a constant voltage to each of the color transfer rollers 58Y, M, and C. On the other hand, a black transfer roller 58K is independently connected to another transformer, and the high-voltage substrate applies voltage controlled at a constant current to the black transfer roller 58K.

Next, a wiring structure that electrically connects the main body-side contact terminal 70 provided on the apparatus main body 12 and the transfer roller 58 will be described with reference to FIG. 2 to FIG. 9.

Figure 2:
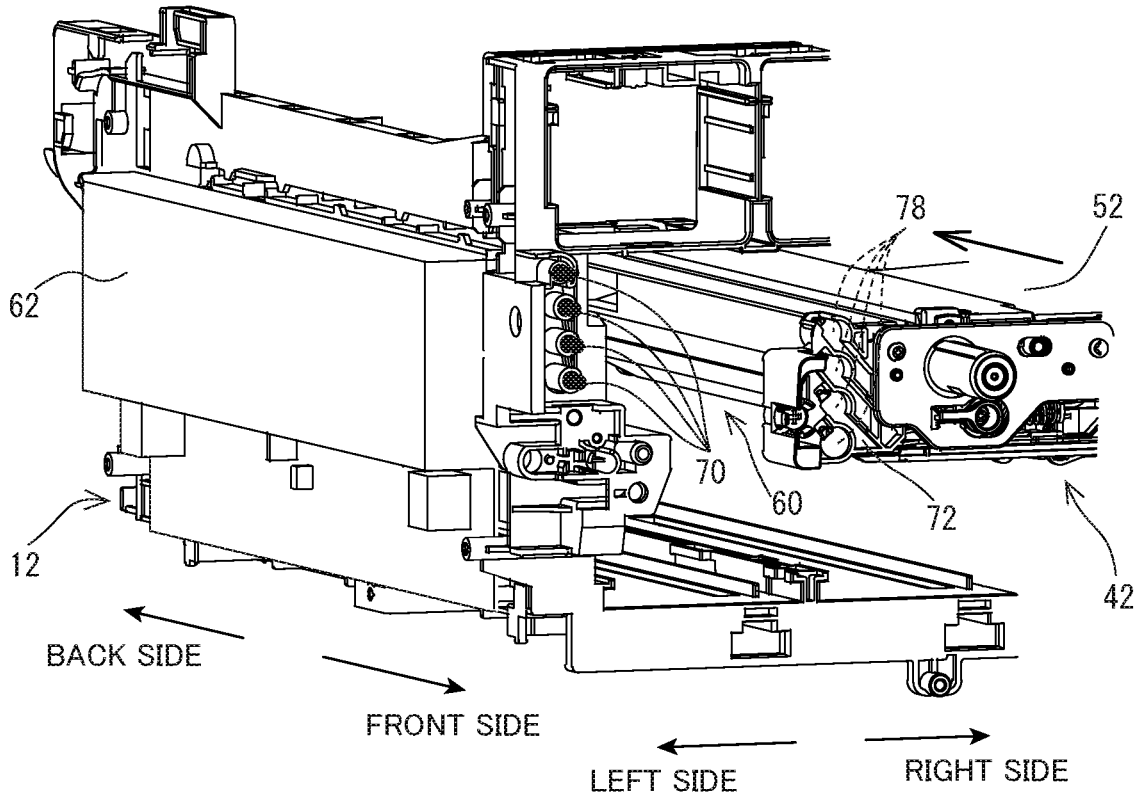
FIG. 2 is an illustrative view illustrating a state when the transfer device is mounted on an apparatus main body of the image forming apparatus.
Figure 3:
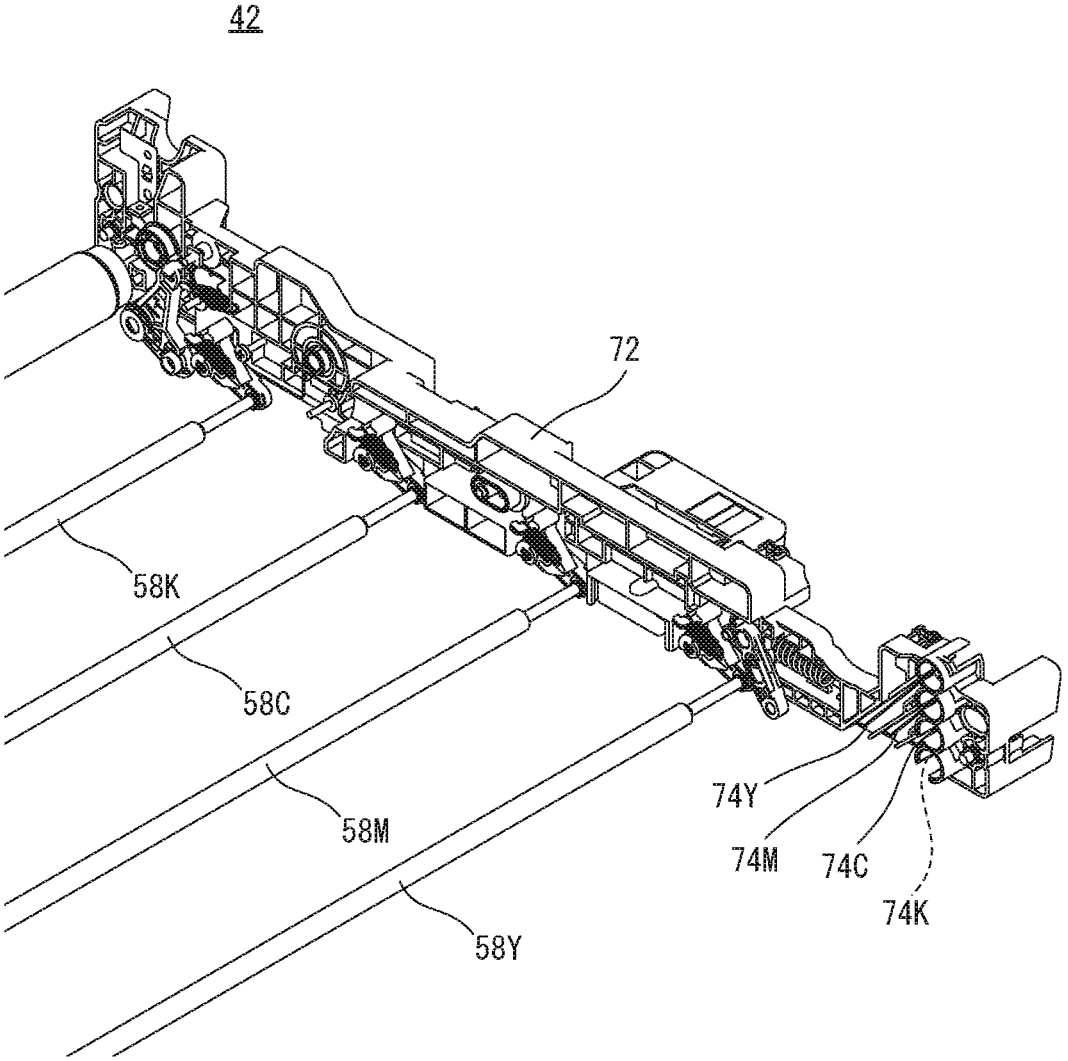
FIG. 3 is an illustrative view illustrating a peripheral portion of a front frame of the transfer device without a transfer belt.
Figure 4:
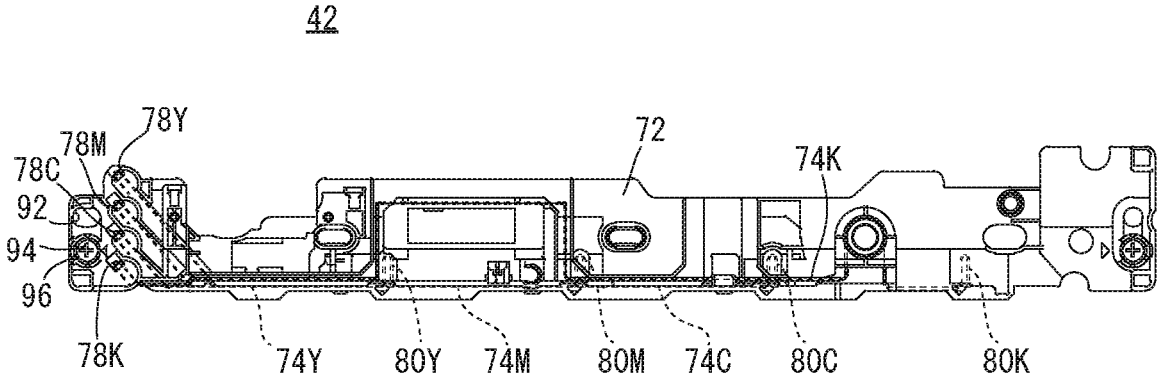
FIG. 4 is a front view illustrating the front frame and a wiring member.
Figure 5:
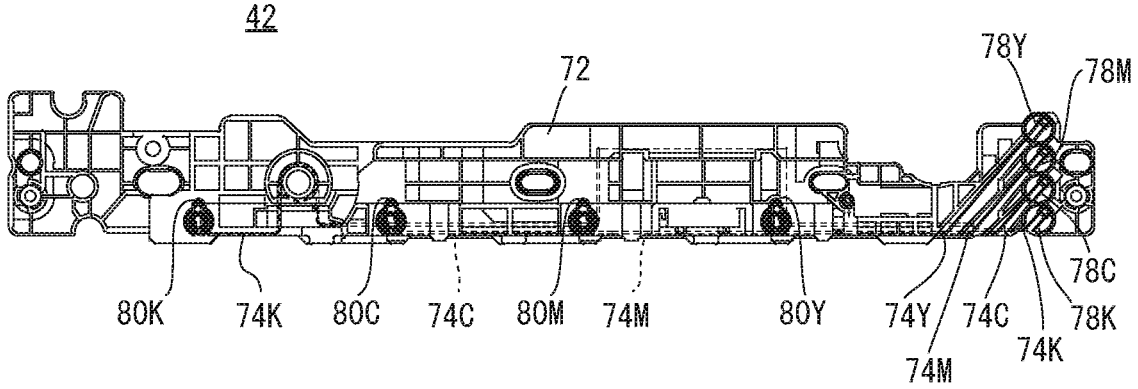
FIG. 5 is a rear view illustrating the front frame and the wiring member.
Figure 6:
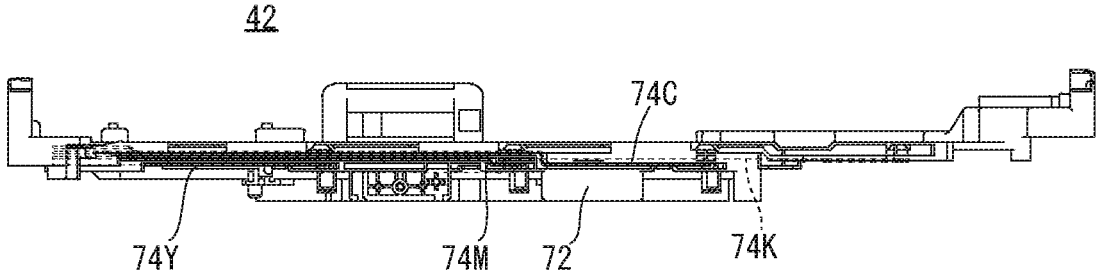
FIG. 6 is a bottom view illustrating the front frame and the wiring member.
Figure 7:
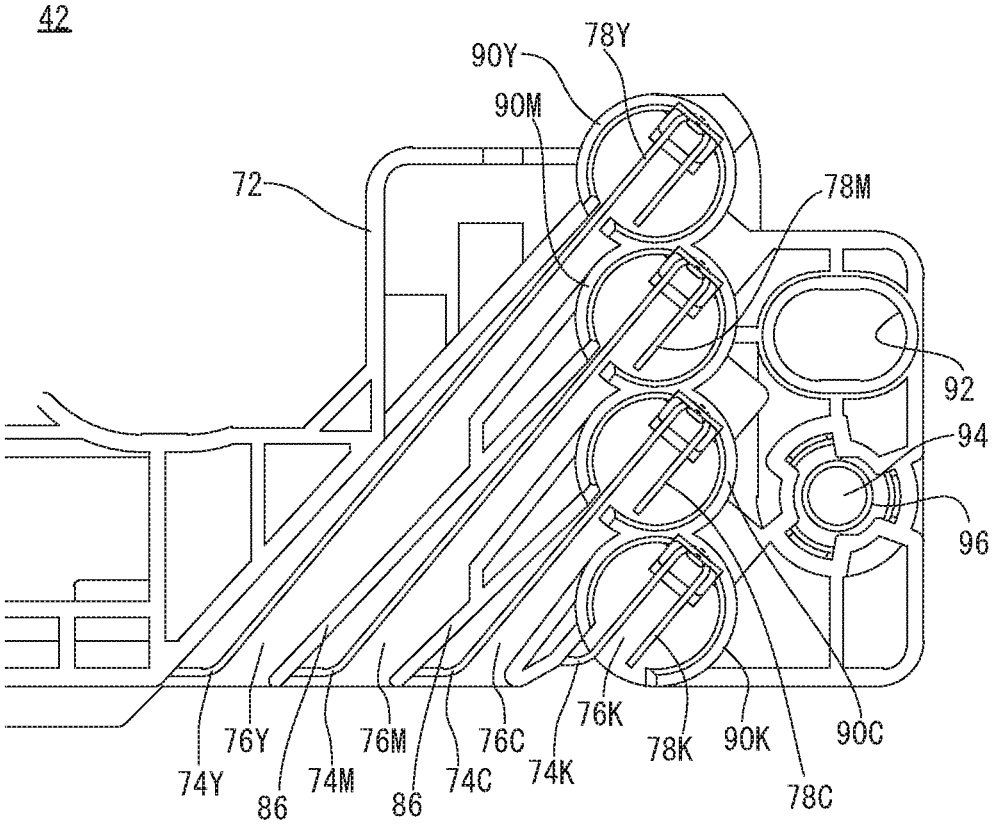
FIG. 7 is an illustrative view illustrating one end of the front frame and the wiring member.
Figure 8:
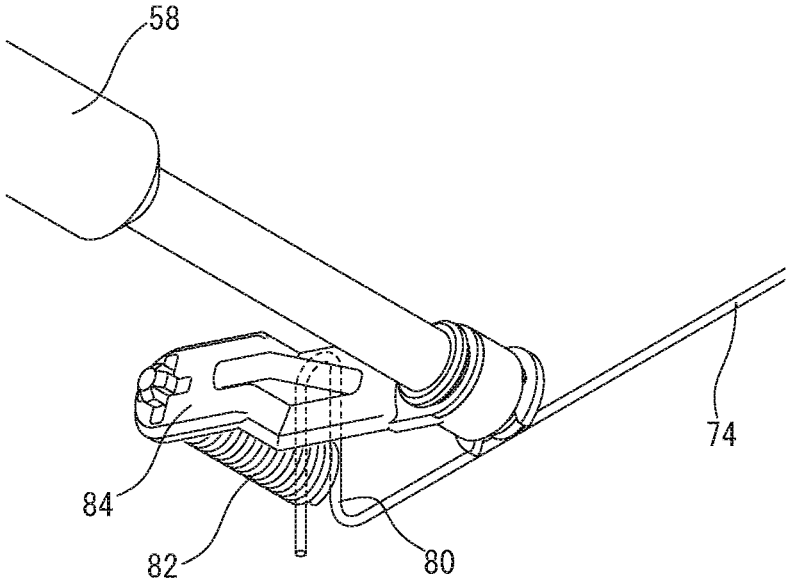
FIG. 8 is an illustrative view illustrating a connection portion between the wiring member and a transfer roller.

As illustrated in FIG. 2, the substrate unit 62 provided with the high-voltage substrate is mounted on the left side of the apparatus main body 12. Further, the four main body-side contact terminals 70 connected to the high-voltage substrate are provided collectively at a front surface-side left end (the left edge of the opening 60) of the apparatus main body 12, and are exposed by placing side by side in a linear arrangement in an up-down direction in the order of Y, M, C, and K from the upper side. The main body-side contact terminals 70 includes a compression coil spring expandable and contractable in an axial direction, and are held to be able to expand and contract inside a terminal holder 88 having a bottomed cylindrical shape (see FIG. 9) so that a leading end of the main body-side contact terminal 70 protrudes forward. When the main body-side contact terminal 70 contacts the transfer device-side contact terminal 78, the compression coil spring is compressed in the axial direction to generate an urging force on the transfer device-side contact terminal 78.

As illustrated in FIG. 3 to FIG. 7, the transfer device 42 includes the four transfer rollers 58 including the black transfer roller 58K and the color transfer rollers 58Y, M, and C. Front ends of the transfer rollers 58 are supported by a front frame 72, and back ends are supported by a back frame (not illustrated). The front frame 72 and the back frame are made of an electrically insulating synthetic resin, and rotatably and displaceably support the four transfer rollers 58.

In the first embodiment, four wiring members 74 that connect each of the main body-side contact terminals 70 and each of the transfer rollers 58 are collectively wired to the front frame 72 of the transfer device 42. That is, in the first embodiment, a transfer frame made of synthetic resin that supports one end of the plurality of transfer rollers 58 is the front frame 72, and a wiring holder 76 (see FIG. 7) that holds each of the four wiring members 74 is formed in the front frame 72.

Each of the wiring members 74 is formed by deforming a single conductive wire. A spring steel wire such as a stainless steel wire, a hard steel wire, a piano wire, and an oil-tempered wire may be used as the wire.

When the transfer device 42 is mounted on the apparatus main body 12, the transfer device-side contact terminal 78 that abuts against the corresponding main body-side contact terminal 70 is formed at one end of each of the wiring members 74. Each of the transfer device-side contact terminals 78 is formed in a U-shape, and the transfer device-side contact terminals 78 are collectively arranged at one end of the front frame 72. Specifically, each of the transfer device-side contact terminals 78 is arranged at a back-side left end of the front frame 72 to correspond to each of the four main body-side contact terminals 70, and are exposed by placing side by side in a linear arrangement in the up-down direction in the order of Y, M, C, and K from the upper side.

Further, each of the wiring members 74 extends from one end (the transfer device-side contact terminal 78) of the front frame 72 to a position near the corresponding transfer roller 58. As easily understood from FIG. 8, the other end (a relay terminal 80) of each of the wiring members 74 is formed in a U-shape, and is connected to a shaft of the transfer roller 58 via a relay member such as a relay spring 82 and a conductive arm 84, or the like.

In the first embodiment, each of the three color wiring members 74Y, M, and C is wired in parallel mainly on a bottom surface of the front frame 72. Specifically, the color wiring members 74Y, M, and C extend diagonally downward to the right from one end arranged on the back-side left end of the front frame 72, and wrap around to the bottom surface side of the front frame 72. Thereafter, the color wiring members 74Y, M, and C pass through the bottom surface side of the front frame 72 to extend to a position near the corresponding color transfer rollers 58Y, M, and C. From this point onward, the other end wraps around to the back side of the front frame 72 to be electrically connected to the relay spring 82.

On the other hand, the black wiring member 74K is wired mainly on a front surface of the front frame 72. Specifically, the black wiring member 74K wraps around to the front surface side of the front frame 72 from one end arranged on the back-side left end of the front frame 72, and then passes through the front surface side of the front frame 72 to extend to a position beyond the color transfer roller 58M. From this point onward, the black wiring member 74K wraps around to the back side of the front frame 72 to extend to a position near the black transfer roller 58K, and the other end is electrically connected to the relay spring 82.

In such the transfer device 42, the front frame 72 is not provided with many other high-voltage components and ground components as compared with the apparatus main body 12. That is, the wiring member 74 can be wired relatively freely on the front frame 72 with little restriction on a wiring path. Therefore, by wiring the wiring member 74 on the front frame 72 as in the first embodiment, it is possible to shorten the wiring path, which makes it easy to secure a creepage distance and a space distance between the wiring members 74.

By wiring the wiring member 74 on the front frame 72, it is possible to set the positional relationship between the other end (the relay terminal 80) of the wiring member 74 and the transfer roller 58 to the same phase in each color. Therefore, it is possible to use common relay members such as the relay spring 82 and the conductive arm 84 or the like for each color, by which the member cost can be reduced.

By collectively arranging the transfer device-side contact terminals 78 at one end of the front frame 72, and collectively arranging the four corresponding main body-side contact terminals 70 near the high-voltage substrate, it is possible to shorten and simplify a wiring path in the apparatus main body 12. That is, it is possible to realize space-saving and cost reduction for the wiring at the apparatus main body 12 side.

Furthermore, by wiring each of the color wiring members 74Y, M, and C on the bottom surface side of the front frame 72, and wiring the black wiring member 74K on the front surface of the front frame 72, that is, by interposing the resin wall of the transfer frame 72 between the color wiring members 74Y, M, and C and the black wiring member 74K, it is possible to appropriately secure the creepage distance therebetween. Therefore, a short circuit between the color wiring members 74Y, M, C and the black wiring member 74K can be appropriately prevented. By wiring the color wiring members 74Y, M, and C close to each other on the bottom surface of the front frame 72 having a sufficient space, it is easy to secure the creepage distance from other ground connection components.

Returning to FIG. 4 to FIG. 7, in the first embodiment, ribs (partitions) 86 are formed between the color wiring members 74Y, M, and C at least in the portion where the color wiring members 74Y, M, and C are wired in parallel in the front frame 72. That is, in the first embodiment, by forming the ribs 86 even between the color wiring members 74Y, M, and C where a large creepage distance is not required as the color wiring members 74Y, M, and C have the same potential, the short circuit between the color wiring members 74Y, M, and C is prevented more reliably.

Figure 9:
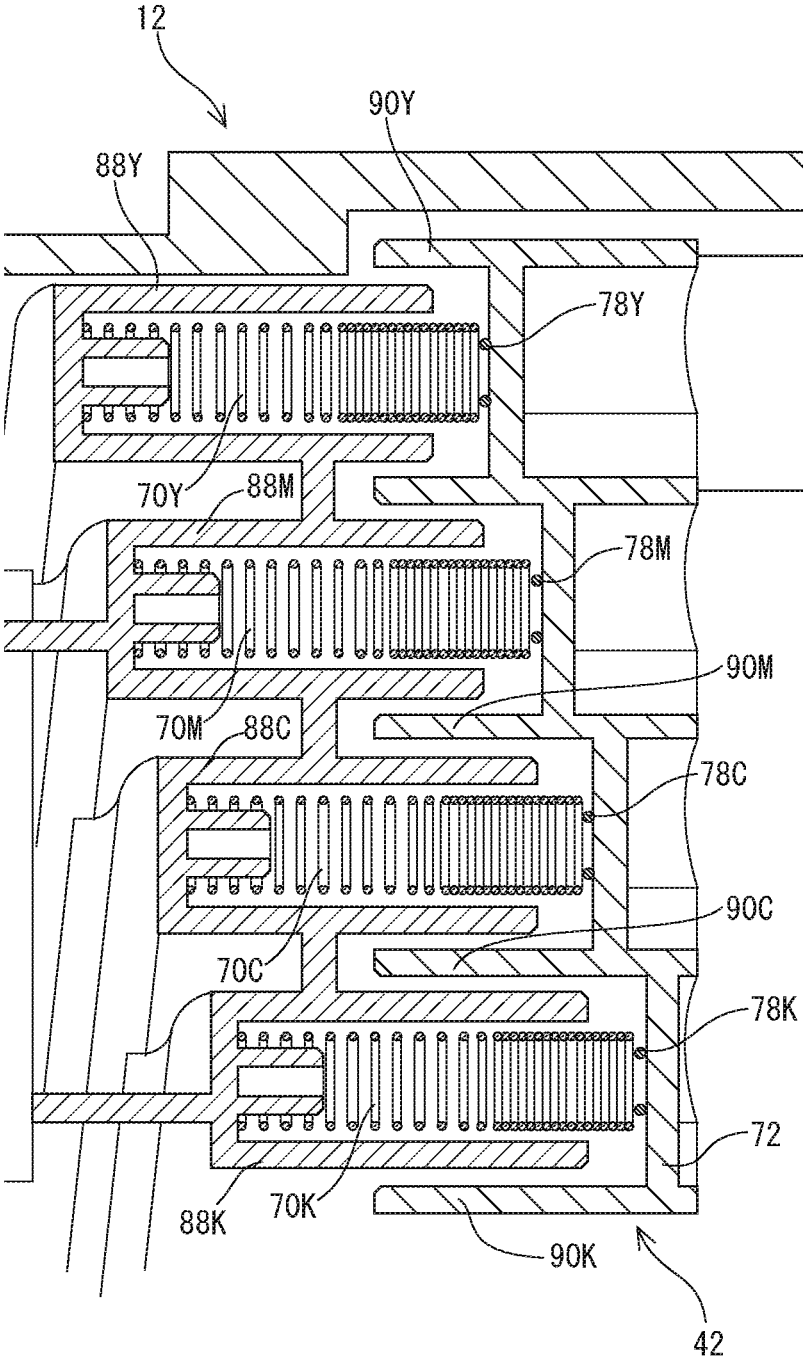
FIG. 9 is an illustrative view illustrating a connection portion between the wiring member and a main body-side contact terminal.

Further, a protrusion 90 having a substantially cylindrical shape that protrudes backward from a peripheral edge of the transfer device-side contact terminal 78 is formed at the back-side left end of the front frame 72. As illustrated in FIG. 9, when the transfer device 42 is mounted on the apparatus main body 12, the protrusion 90 overlaps the terminal holder 88 formed on the apparatus main body 12, and surrounds the leading end of the terminal holder 88. Thus, the creepage distance between the contacts of the main body-side contact terminal 70 and the transfer device-side contact terminal 78 of each color is appropriately secured, and a short circuit between the adjacent contacts is reliably prevented.

Further, a positioning hole 92 and a screw mounting hole 96 to which a fastening screw 94 is mounted are formed side by side in the up-down direction at a left end of the front frame 72 (specifically, to the left of the position where the transfer device-side contact terminals 78 are arranged). The positioning hole 92 is a component (positioner) that positions the transfer device 42 with respect to the apparatus main body 12 by being fitted with a positioning boss (not illustrated) formed in the apparatus main body 12. However, the positioning boss may be formed at the front frame 72 side. The fastening screw 94 is a fixing member that fixes the transfer device 42 to the apparatus main body 12

In this way, by arranging the main body-side contact terminals 70 and the transfer device-side contact terminals 78 in a position close to the positioning boss and the positioning hole 92 in sets of four colors, it is possible to stabilize the positional relationship between the contact terminals. Further, by arranging the main body-side contact terminals 70 and the transfer device-side contact terminals 78 at a position close to the fastening screw 94 in sets of four colors, the front frame 72 becomes more resistant to bending or the like due to pressure from the main body-side contact terminals 70, and thus, it is possible to stabilize the posture of the transfer device 42.

As described above, according to the first embodiment, it is possible to secure the creepage distance and the space distance between the color wiring members 74Y, M, and C and the black wiring member 74K with a simple configuration in which the color wiring members 74Y, M, and C are arranged on a first surface of the front frame 72, and the black wiring member 74K is arranged on a second surface of the front frame 72, and thus, appropriately prevent a short circuit between the wiring members 74.

According to the first embodiment, the plurality of wiring members 74 are wired on the front frame 72, and the transfer device-side contact terminals 78 are collectively arranged at one end of the front frame 72, which makes it possible to shorten a wiring path in the transfer device 42, and easily secure the creepage distance and the space distance between the wiring members 74. It is also possible to shorten and simplify the wiring path in the apparatus main body 12, thus realizing space-saving and cost reduction for the wiring at the apparatus main body 12 side. Further, it is possible to set the positional relationship between the other end of the wiring member 74 and the transfer roller 58 to the same phase in each color, and have a common relay member in each color, by which the member cost can be reduced.

Second Embodiment

Next, the transfer device 42 according to a second embodiment of the present invention will be described with reference to FIG. 10. In the second embodiment, a surface of the front frame 72 on which the color wiring members 74Y, M, C and the black wiring member 74K are wired is different from the above-described first embodiment. The rest is the same as in the first embodiment, and thus, duplicated description will be omitted. Duplicated description will be omitted also in other embodiments.

Figure 10:
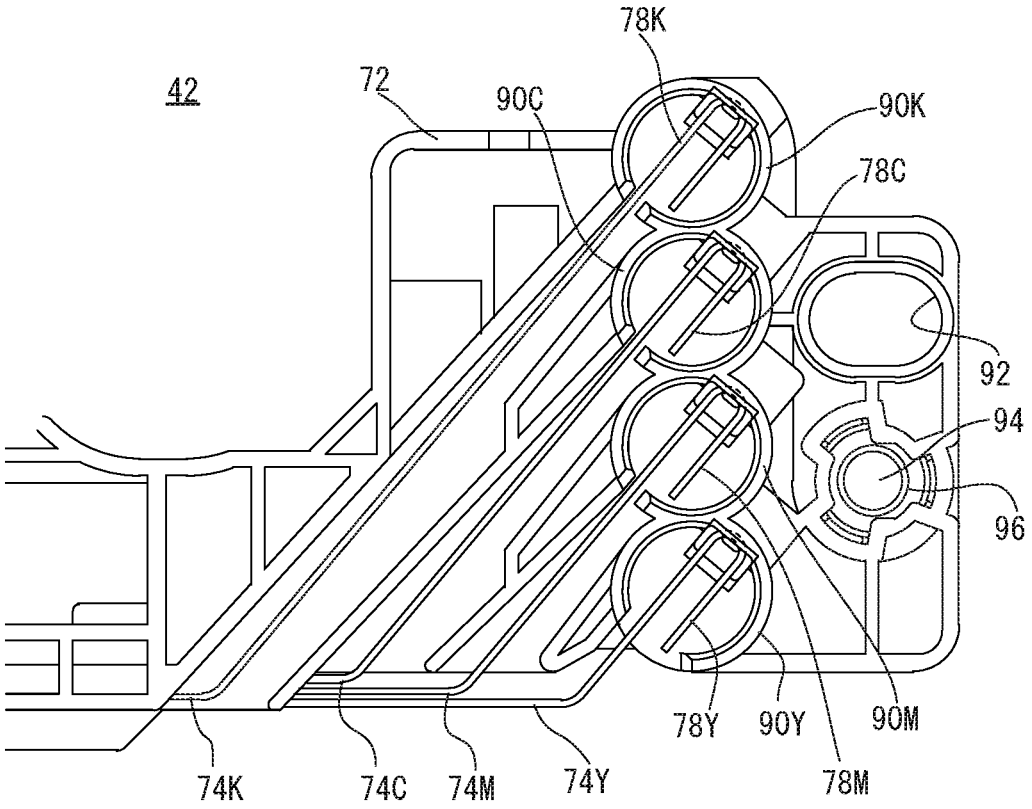
FIG. 10 is an illustrative view illustrating one end of a front frame and a wiring member included in a transfer device according to a second embodiment of the present invention.

As illustrated in FIG. 10, in the second embodiment, each of the three color wiring members 74Y, M, and C is wired mainly on the front surface of the front frame 72. On the other hand, the black wiring member 74K is wired mainly on the bottom surface of the front frame 72. Each of the transfer device-side contact terminals 78 is arranged side by side in a linear arrangement in the up-down direction in the order of K, C, M, and Y from the upper side at the back-side left end of the front frame 72.

In the second embodiment also, similar operation and effect as those of the first embodiment can be obtained, and it is possible to appropriately secure the creepage distance between the color wiring members 74Y, M, C and the black wiring member 74K, and thus appropriately prevent a short circuit between the color wiring members 74Y, M, C and the black wiring member 74K.

Third Embodiment

Although not illustrated, in the third embodiment, each of the three color wiring members 74Y, M, and C is wired mainly on the bottom surface of the front frame 72. On the other hand, the black wiring member 74K is wired mainly on an upper surface of the front frame 72. Each of the transfer device-side contact terminals 78 is arranged side by side in a linear arrangement in the up-down direction in the order of K, C, M, and Y from the upper side at the back-side left end of the front frame 72.

According to the third embodiment, it is possible to secure the creepage distance between the color wiring members 74Y, M, C and the black wiring member 74K more appropriately, and thus appropriately prevent a short circuit between the color wiring members 74Y, M, C and the black wiring member 74K.

Fourth Embodiment

Although not illustrated, in the fourth embodiment, each of the three color wiring members 74Y, M, and C is wired mainly on the front surface of the front frame 72. On the other hand, the black wiring member 74K is wired mainly on the upper surface of the front frame 72. Each of the transfer device-side contact terminals 78 is arranged side by side in a linear arrangement in the up-down direction in the order of K, C, M, and Y from the upper side at the back-side left end of the front frame 72.

In the fourth embodiment also, similar operation and effect as those of the third embodiment can be obtained, and it is possible to secure the creepage distance between the color wiring members 74Y, M, C and the black wiring member 74K more appropriately, and thus appropriately prevent a short circuit between the color wiring members 74Y, M, C and the black wiring member 74K.

In each of the above-described embodiments, each of the wiring members 74 is wired on the front frame 72. However, each of the wiring members 74 may be wired on the back frame. That is, the transfer frame made of synthetic resin that supports one end of the plurality of transfer rollers 58 in the present invention may be a back frame. Even when each of the wiring members 74 is wired on the back frame, each of the transfer device-side contact terminals 78 is collectively arranged at one end of the back frame, and the color wiring members 74Y, M, and C are arranged on a first surface of the back frame, and the black wiring member 74K is arranged on a second surface of the back frame. For example, the color wiring members 74Y, M, and C are wired mainly on a bottom surface of the back frame, and the black wiring member 74K is wired mainly on the back surface of the back frame.

Compared with the apparatus main body 12, the back frame is not provided with many other high-voltage components and ground components. Therefore, as in the case of the front frame 72, by wiring the wiring members 74 on the back frame, it is possible to shorten the wiring path, which makes it easy to secure the creepage distance and the space distance between the wiring members 74. However, in consideration of the ease of positioning the main body-side contact terminals 70 and the transfer device-side contact terminals 78, it is more preferable to wire each of the wiring members 74 on the front frame 72.

It is noted that the specific numerical values, component shapes, and the like described above are merely examples, and can be appropriately changed as necessary, depending on the product specifications, and the like.

What is claimed is:

1. A transfer device that is mounted to be attachable to and detachable from an apparatus main body and receives power supply from a high-voltage substrate provided on the apparatus main body, the transfer device comprising:

a transfer belt;

a plurality of transfer rollers that include a black transfer roller and a plurality of color transfer rollers, and are arranged side by side in a traveling direction of the transfer belt;

a transfer frame that supports one end of the plurality of transfer rollers; and a plurality of wiring members that include a black wiring member and a plurality of color wiring members, and electrically connect a plurality of main body-side contact terminals provided on the apparatus main body and the plurality of transfer rollers when the transfer device is mounted on the apparatus main body, wherein each of the plurality of wiring members includes, at one end, a transfer device-side contact terminal that abuts against a corresponding main body-side contact terminal of the plurality of main body-side contact terminals when the transfer device is mounted on the apparatus main body, the plurality of wiring members are wired on the transfer frame, and each of the transfer device-side contact terminals is collectively arranged at one end of the transfer frame, and the black wiring member is wired on a surface of the transfer frame different from a surface of the transfer frame on which the plurality of color wiring members are wired.

2. The transfer device according to claim 1, wherein each of the plurality of color wiring members is wired on a same surface of the transfer frame.

3. The transfer device according to claim 1, wherein the transfer device is attached to and detached from an opening formed on a front surface of the apparatus main body, the plurality of transfer rollers are arranged to extend in a front-rear direction of the apparatus main body, and the transfer frame is a front frame that holds front ends of the plurality of transfer rollers.

4. The transfer device according to claim 3, wherein each of the plurality of color wiring members is wired on a bottom surface of the front frame, and the black wiring member is wired on a front surface of the front frame.

5. The transfer device according to claim 1, further comprising:

a protrusion formed on the one end of the transfer frame to cover a peripheral edge of the device-side contact terminal.

6. The transfer device according to claim 1, further comprising:

a positioner that is provided at the one end of the transfer frame and positions the transfer device with respect to the apparatus main body.

7. An image forming apparatus, comprising:

an apparatus main body provided with a high-voltage substrate; and the transfer device according to claim 1 that is mounted to be attachable to and detachable from the apparatus main body and receives power supply from the high-voltage substrate.

* * * * *